United States Patent [19]

Blum

[11] 4,060,345

[45] Nov. 29, 1977

[54] SUBMERSIBLE PUMP WITH GUIDE MEANS

[76] Inventor: Albert Blum, Scheiderhoehe, Lomar, Germany

[21] Appl. No.: 470,078

[22] Filed: May 15, 1974

Related U.S. Application Data

[63] Continuation-in-part of Ser. No. 203,304, Nov. 30, 1971, Pat. No. 3,861,834.

[30] Foreign Application Priority Data

Jan. 30, 1970 Germany ..... 2004168

[51] Int. Cl.[2] ..... F04B 17/06; F04B 35/04

[52] U.S. Cl. ..... 417/360

[58] Field of Search ..... 417/360, 361; 415/201, 415/219 C; 285/24, 27, 330; 222/333

[56] References Cited

U.S. PATENT DOCUMENTS

| | | | |
|---|---|---|---|
| 3,018,925 | 1/1962 | Englesson | 417/360 |
| 3,234,885 | 2/1966 | Englesson | 417/360 |
| 3,413,021 | 11/1968 | Potts | 285/330 X |
| 3,656,871 | 4/1972 | Carlsson | 417/361 |
| 3,797,970 | 3/1974 | Blum | 417/360 |

FOREIGN PATENT DOCUMENTS

| | | | |
|---|---|---|---|
| 1,187,931 | 2/1965 | Germany | 417/360 |

*Primary Examiner*—William L. Freeh

*Attorney, Agent, or Firm*—Lackenbach, Lilling & Siegel

[57] ABSTRACT

A submersible pump with guide means wherein guide elements include a guide sleeve provided with an aligning gap which during lowering of the pump assembly slides upon an aligning rail connected to the foot of the delivery conduit of the pump.

18 Claims, 12 Drawing Figures

FIG. 3
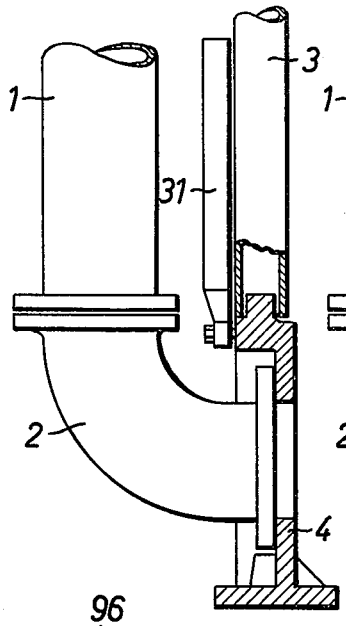
FIG. 4
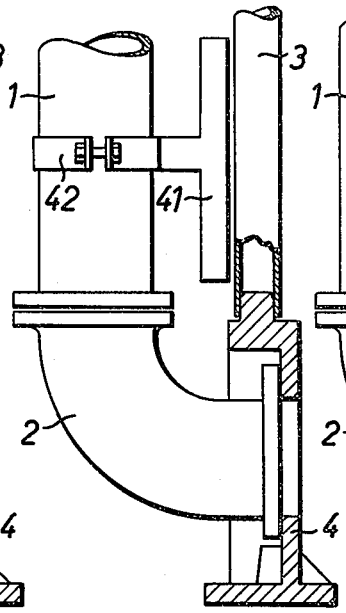
FIG. 5
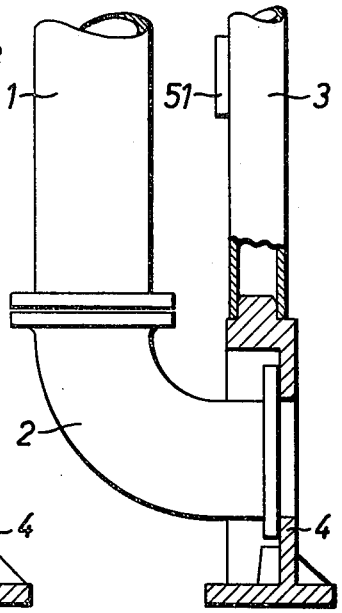
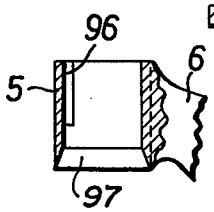
FIG. 12
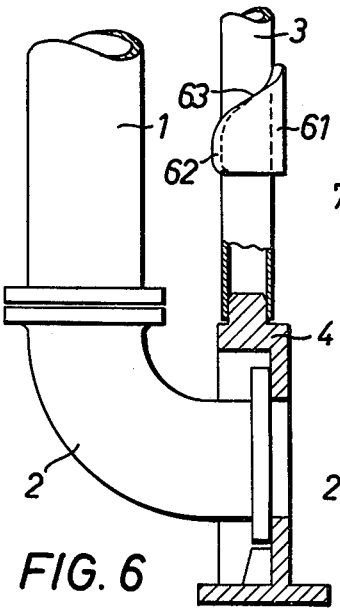
FIG. 6
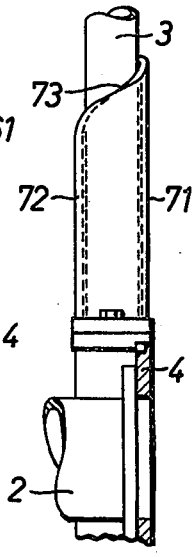
FIG. 7
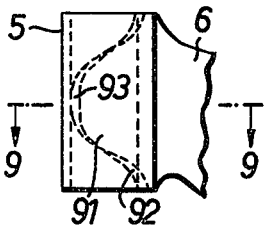
FIG. 8
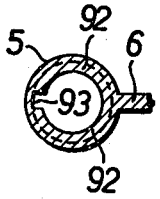
FIG. 9
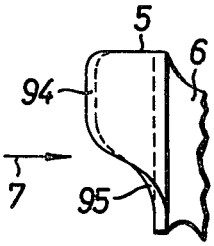
FIG. 10
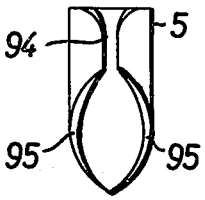
FIG. 11

SUBMERSIBLE PUMP WITH GUIDE MEANS

RELATED APPLICATIONS AND BACKGROUND OF THE INVENTION

This application is a continuation-in-part of applicant's co-pending patent application also entitled "SUBMERSIBLE PUMP WITH GUIDE MEANS" and identified as U.S. Ser. No. 203,304, filed Nov. 30, 1971 now U.S. Pat. No. 3,861,834, granted Jan. 21, 1975.

This invention is an improvment in or modification of the invention disclosed in my related co-pending U.S. patent Ser. No. 150,965, filed June 8, 1971 (now U.S. Pat. No. 3,797,970) which relates to an arrangement of the kind (herein called "the kind defined") comprising guide means and a submersible electric motor-pump assembly which is lowerable into a tank and which comprises an electric drive motor and a pump connected therewith and which has guide elements guided on the said guide means for bringing a pressure discharge pipe of the pump opposite to an inlet aperture of a connecting pipe of a delivery pipe when the assembly is in the lowered position.

In the known devices of this type it is made certain that the pump assembly retains a specified alignment during its descent, so that it arrives in the lower end-position in proper alignment; only thus is it possible to ensure a proper match between the pump delivery and the intake of the discharge pipe. In the known devices of the prior art, profiled rails — with I or square sections, for example — are used, in conjunction with guidance elements adapted to slide on the profiled guide rail; the pump assembly is attached to the guidance element and is thereby prevented from rotating about the axis of the guide rail during its movement into the lower end-position. More specifically pairs of pipes with circular cross-sections have been utilized as guides — for reasons of economy — upon which the guidance element is slideably mounted.

The instant invention aims at simplification and reduction of cost and provides for the secure guidance of the submersible pump assembly into the properly aligned final position for the match between pump discharge and the inlet opening of the discharge line with the use of only a single guide tube with circular cross-section. Such tubes (pipes) are commercial and are available everywhere in all sizes, or can be obtained readily. Savings are thereby achieved not only in the direct cost of materials for the guides of 50%. but also in the cost of transportation since no stiff profile rails have to be delivered along with the pump.

For this purpose, the invention provides for the subordination of alignment elements to the guidance elements — comprising the stationary guides and the guide elements sliding thereupon — so that one alignment element is associated with the stationary guide, or other parts attached thereto, while the other alignment element is associated with the moveable guide element; the two alignment elements engage each other when the pump assembly is still a certain distance from its lower end-position during its descent and align the pump assembly automatically into the "aligned" position during its further descent.

So for example, on a guide tube there may be provided as an aligning element, an aligning pin or an aligning rib or rail or the like extending parallel to the tube axis, over which there slides a recess on the inner circumference of a guide element in the form of a sleeve which in development has a funnel or double funnel shape and widens from an inlet aperture for the aligning pin or rib downwardly or upwardly respectively to one half the circumference of the sleeve. Naturally, in kinematic reversal, there may also be provided an aligning sleeve with a funnel-shaped upwardly-widening recess at a suitable distance from the lower end position at the outer circumference of the guide tube, and an aligning pin or rail at the inner circumference of the guide sleeve. Naturally, also upwardly a suitable inlet funnel may be provided in either of these instances.

This form of embodiment is comparatively expensive and is also basically unsatisfactory becuase it entails the requirement that the manual laborer erectng the installation shall exercise more than a good expert knowledge, which nowadays is not always available. Therefore, the invention is intended to provide a modification of the previously proposed arrangement which permits an intensive prefabrication in a factory and allows erection by uninstructed persons or those only briefly instructed without difficulties arising therefrom.

For this purpose the present invention provides an arrangement of the kind defined herein, further characterized in that said guide elements include a guide sleeve provided with an aligning gap which during lowering of the pump assembly slides upon an aligning rail connected to the foot of the delivery conduit. Preferably the aligning gap of the guide sleeve widens downwardly in a conical or funnel-shape or other similar form in order to ensure the sliding of the aligning gap on the aligning rail even if the positioning of the parts relative to each other deviates widely from the requisite position. It is important that the aligning rail does not need to be mounted on the guide tube which is usually acquired only at the place of installation, but on the contrary the aligning rail can previously be secured in the factory to the foot of the delivery conduit or can be arranged there for the connection. Also at its lower end the aligning rail can widen conically and be connected with a fastening block which serves as an abutment for limiting the downward motion of the guide sleeve.

The invention permits manifold possibilities of embodiment. The scope of the monopoly sought is defined in the Claims hereinafter and how the invention may be put into practice is described with reference to the accompanying drawings in which by way of example one form of embodiment is illustrated in views showing the parts important for comprehension of the invention, and therein:

FIG. 3 is a side elevational view, partly in section, of a pump without the pump portion, but showing an upwardly leading delivery conduit and the aligning rail secured to the connection foot;

FIG. 4 is a side elevational view, partly in section, of another alternate embodiment of the invention wherein the aligning rail is affixed or secured to the discharge delivery conduit;

FIG. 5 is a side elevational view, partly in section, of another embodiment of the invention wherein the aligning rail is secured to the guide element;

FIG. 6 is a side elevational view, partly in section, of alternate embodiment of the invention wherein the aligning slot is provided on a stationary portion in contrast to being provided on a moving portion;

FIG. 7 is a side elevational view, partly in section, of an alternate embodimennt of FIG. 6 wherein the aligning slot is provided in a tube which is pushed over the guide tube and fastened to the foot or base of the pump assembly;

FIg. 8 is a side elevational view of an alternate guide sleeve of the invention having an aligning groove in the guide sleeve and an aligning slot or a slit;

FIG. 9 is a sectional view taken along the line 9—9 of FIG. 8;

FIG. 10 is an alternate guide sleeve of the invention;

FIG. 11 is a front view looking in the direction of the reference arrow 7 of FIG. 10 showing the alternate guide sleeve of the invention; and FIG. 12 is another alternate embodiment of a guide sleeve of the invention wherein an alignment rib is provided on the inner surface of the guide sleeve.

DESCRIPTION OF THE PREFERRED EMBODIMENTS OF THE INVENTION

Figure 1:
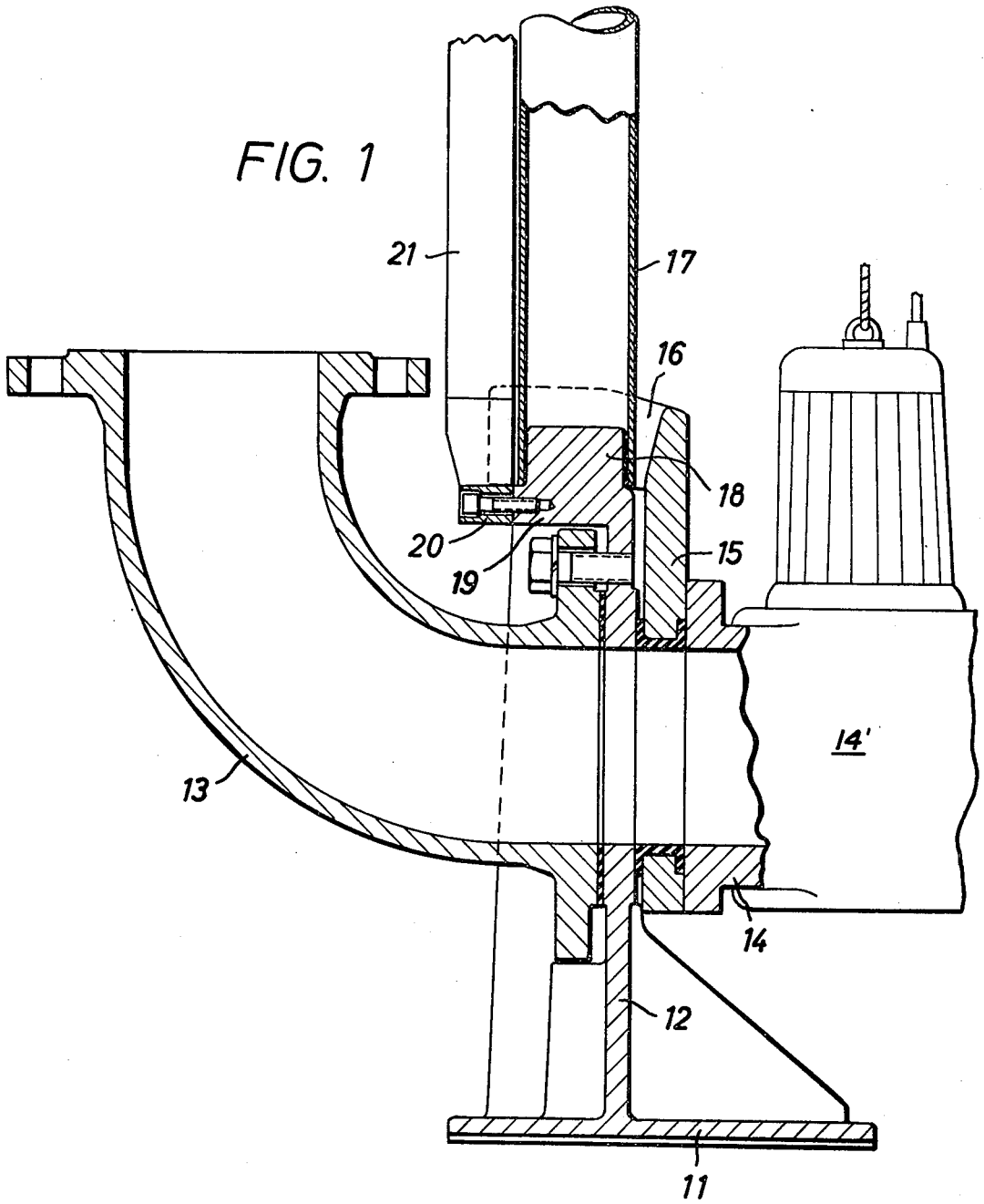
FIG. 1 shows in vertical section the connection foot of a pump assembly with the adjacent parts of the delivery conduit and guide means and pump.
Figure 2:
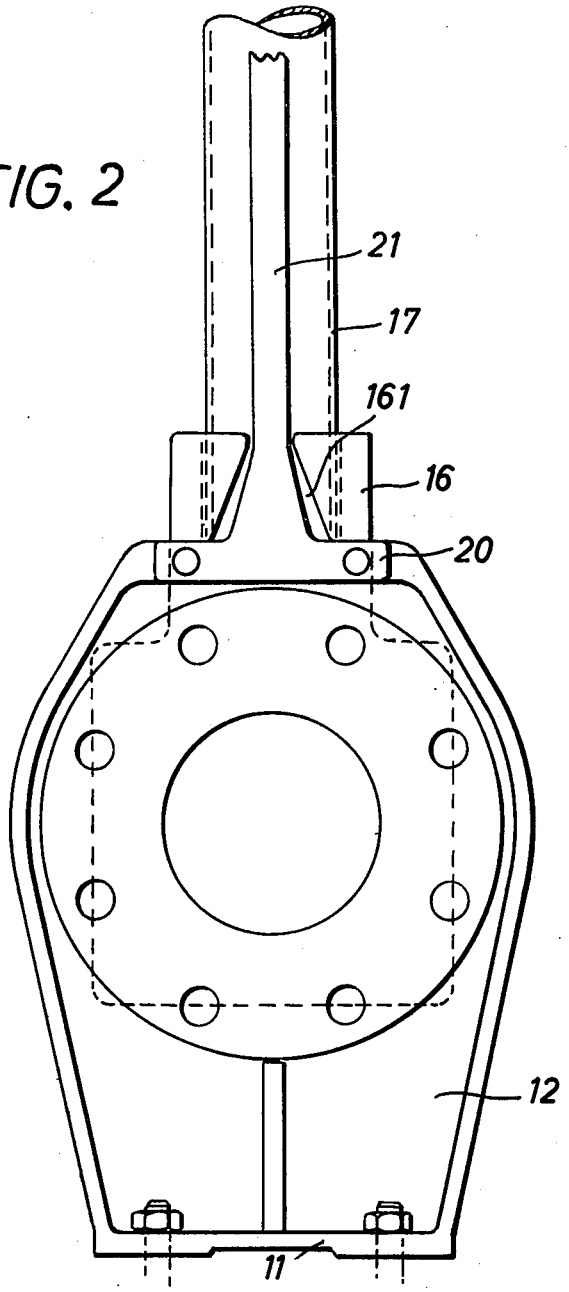
FIG. 2 shows a view from the side of the pipe bend of the delivery conduit with the pipe bend and motor-pump unit removed.

In the drawings, as best shown in FIGS. 1–2, there is a form of embodiment in which located on the bottom of a container and carried by a foot 11 is a connection plate 12 to which from one side, a pipe bend 13 of the upwardly leading delivery conduit (not shown) is secured by means of flanges, while against the other side there presses tightly the delivery outlet piece 14 of the motor-pump unit 14' with a complementary intermediate adaptor 15. This intermediate adaptor 15 carries at its upper end as a guide element for the pump a guide sleeve 16 which substantially annularly engages around a guide tube 17 with circular cross-section serving for the guiding of the pump assembly.

With its lower end this guide tube 17 is guided over a retaining boss carried by the connection plate 12 and can be secured thereon by means of a fastening pin (not shown). To the support 19 carrying the retaining boss 18 for the guide tube 17 with the connection plate 12 there is further fastened by means of a fastening block 20 an upwardly directed aligning rail 21. The fastening block 20 at the same time serves as an abutment for the guide sleeve 16 and limits the downward motion of the pump, which upon engagement of the guide sleeve 16 against the fastening block 20 lies under the influence of its own weight with the intermediate adaptor 15 against the connection plate 12, so that through this connection plate there is produced the tight connection between the pump delivery outlet piece 14 and the delivery conduit pipe bend 13 in a suitable position. Prior to this the guide sleeve 16 has slid with its aligning gap 161 upon the aligning rail 21 in order to bring the pump delivery outlet piece 14 and the delivery conduit pipe bend 13 together in an upright position before the pump delivery outlet piece 14 and the connection plate 12 have neared each other to such an extent that they abut against one another. In order to facilitate the sliding of the gap 161 on to the rail 21 the gap widens downwardly in the manner illustrated in the drawing or even to a greater extent so that in every instance it is ensured that the gap 161 slides with certainty on the rail 21. By this means it is achieved that the aligning rail 21 does not need to be mounted for the first time at the site of installation of the pump upon the guide acquired there, from which difficulties can easily arise, but — if it is not provided already mounted — still needs only to be screwed to the connection plate at the installation site, everything being already previously prepared for the fastening by screws.

With respect to FIGS. 3–12, such figures indicate various embodiments of the invention which one can utilize if the guidance is to be achieved with the use of a single pipe of conventional form with a circular cross-section. Inasmuch as such a circular tube does not maintain or guide a descending pump assembly in a specific, aligned position, the use of a round guide tube is only possible when one provides, in addition to the guide tubes, aligning devices comprising aligning elements of which one is associated with a stationary portion of the assembly (guide tube, base for the guide tube and discharge tube) and the other of which is associated with the moveable portion (pump, drive motor, and, particularly, the guide sleeve).

Thus, five embodiments of the fixed portion and three embodiments of the moveable portion are illustrated in FIGS. 3–12. In all of the examples, like reference numerals have been utilized wherever possible so that the differennt embodiments of the invention can be readily understood without difficulty, particularly when comparing one embodiment relative to another embodiment.

With respect to all of the embodiments of FIGS. 3–12, the discharge or delivery conduit is identified by the numeral 1, the pipe elbow 2 (corresponding to the inlet pipe bend 13 of FIGS. 1 and 2), the guide with a single circular guide tube is identified by the numeral 3, and the base (foot) for the discharge pipe 1 and the guide tube is identified by the numeral 4.

In the embodiment of FIG. 3, an alignment rail 31 is secured to the base 4 and extends upwardly from the base 4 along the guide tube 3. This alignment rail 31 corresponds to the alignment rail 21 of the embodiments of FIGS. 1 and 2. As best shown in FIG. 4, such an alignment rail can be substituted by an aligning rail 41 affixed to the discharge pipe by means of a suitable pipe clamp 42. The aligning rail 51 is secured directly to the guide tube 3.

In the embodiment of FIG. 6, a sleeve-like aligning element 61 is attached to the guide tube 3 and is further provided with an aligning slit into which the mating aligning element is led by surfaces 63 which cant or slop downward from a point opposite the slit 62. In the alternate embodiment of the invention illustrated in FIG. 7, the aligning slot or slit 72 is provided in a tube 71 which is pushed over the guide tube 3 and may be fastened to the base 4. The upper portion of this tube 71 or aligning element is provided with sloped surfaces 73 whose upper boundaries correspond to the surfaces 63 of the embodiment of FIG. 6.

In the illustrated embodiments of the invention wherein the guide sleeve slides over the guide tube 3, the sleeve is referred to as at 5 in FIG. 12, and the attached arm connects the guide sleeve with the moveable portion of the assembly as illustrated by the reference numeral 6 in FIG. 12. Of course, in FIG. 12 the element 96 is the alignment rib provided on the inner surface of the guide sleeve 5.

In the embodiment of FIGS. 8 and 9, the inner surfaces are provided with a square, or parallelogram-like, projecting surface 91 (see applicant's related patent application identified hereinabove now as U.S. Pat. No. 3,797,970) which develops along the boundary surfaces 92 at the sides into a groove (or key-way) 93. This groove or key-way forming the aligning element.

The guide sleeve 5 is itself split in the embodiments of FIGS. 10 and 11, and it will be appreciated that the guide sleeve is provided with an aligning slit 94 with which it can slide over the aligning rail 31, 41 or 51. The lower boundary surfaces 95 of the guide sleeve 5 are, starting from the slit 94, canted or sloped downwardly at a sharp angle so that they meet in an acute angle at the side of the sleeve 5 opposite to the slit 94.

It will be appreciated that the sleeve 5 always contacts the upper end of the alignment rail (31, 41 and 51) with one of its canted or sloped surfaces 95 in the descent of the pump assembly; the alignment rail glides into the slit 94 with the simultaneous alignment of the pump assembly, whereby the required position of the pump assembly is attained. In the embodiment of FIG. 12, an alignment rib 96 as noted hereinabove is provided on the inner surface of the guide sleeve 5 and this rib 96 contacts the boundary surfaces 63 (or 73) with its lower end during the descent of the pump assembly. These boundary surfaces lead it (the rib) into the alignment slit 62 (or 72) — with the simultaneous alignment and descent of the pump assembly — which determines the required position of the pump assembly. The inner lower surface of the guide sleeve 5 is bevelled as at 97 in order to facilitate the smooth transition of the guide sleeve 5 over the co-operatively associated fixed guide sleeve 61, 71 so that the inner rail or rib-like element 96 smoothly enters the slots 62, 72 directly if by chance same is axially aligned or by travelling along the sloped surfaces 63, 73.

It will be appreciated that FIGS. 3–5 show those embodiments of the invention in which the aligning rail is provided on the stationary portion while the embodiments according to FIGS. 6 and 7 provide the aligning slot on the stationary portion. In the three embodiments of the moveable portion the alignment element is always attached to the guide element, that is, to the guide sleeve.

FIGS. 8 and 9, and the corresponding FIGS. 10 and 11, show embodiments with an aligning groove in the guide sleeve and an aligning slot or slit. FIG. 12 illustrates the aligning rib in the sleeve 5 as part of the moveable member.

It will be recognized that the guide sleeve shown in FIGS. 8 and 9 is utilized with the aligning rail according to FIG. 5 and it is this combination which corresponds to the applicant's U.S. Pat. No. 3,797,970 referred to hereinabove. The guide sleeve of FIGS. 10 and 11 is applicable to the guides and aligning elements of FIGS. 3 and 4; and the combination of the elements of FIG. 3 with the sleeve of FIGS. 10 and 11 corresponds to the embodiment of applicant's shown in FIGS. 1 and 2. The guide sleeve of FIG. 12 may be used either with the guide according to FIG. 6 or with the modified design of FIG. 7.

Accordingly, the invention in its broadest form discloses the secure guidance of pump assemblies may be achieved with the aid of a single round tube of circular cross-section wherein a preselected position is established with reference to the lower end of the discharge pipe. Of course, in addition to the round circular tube, the guide tube — or stationary parts connected with the guide tube, such as the base (foot) for the discharge line and guide tube or, possibly, the discharge line itself — is provided with aligning elements which engage aligning elements connected with the pump assembly, and more specifically with its guide element, and which engages when the pump assembly is still some distance from its lower end position.

With respect to the term "required position" used hereinabove, same refers to a position which is to be assumed by a body and into which it is moved, if in any particular instance or possibility it has not already been possessed thereof (of the specified position). Such phrase "required position" is analogous to the applicant's use in the original parent specification of the phrase "from the datum position".

Although the present invention has been disclosed in some detail by way of illustration and example for purposes of clarity of understanding, it will, of course, be understood that various changes and modifications may be made in the form, details, and arrangment of the parts without departing from the scope of the invention as set forth in the claims.

What is claimed is:

1. A submersible electric motor-pump assembly having a drive motor and a pump connected therewith, which is lowerable into a body of fluid with the outlet of said pump being guided into engagement with a discharge pipe, comprising: guiding means in the form of a single element of circular cross-section and co-operatively associated male and female secondary aligning elements of mating rib and slot configurations, one of which is part of a fixed stationary reference and the other being a part of said moveable motor-pump assembly and being disposed about said guiding means of circular cross-section; and said male and female aligning elements together being adapted to co-operatively align the outlet of said motor-pump assembly with said discharge pipe as said assembly is brought into proximity to the outlet of said pump, whereby alignment of the motor-pump assembly with said discharge pipe is achieved by said aligning elements shortly before said motor-pump assembly reaches its lowest travel position.

2. A submersible electric motor-pump assembly having a drive motor and a pump connected therewith, which is lowerable into a body of fluid with the outlet of said pump being guided into engagement with a discharge pipe, comprising: guiding means in the form of a single element of circular cross-section and co-operatively associated male and female secondary aligning elements of mating rib and slot configurations, one of which is part of a fixed stationary reference and the other being a part of said moveable motor-pump assembly and being disposed about said guiding means of circular cross-section; said guiding means being in the form of a circular pipe extending upwardly from a fixed position proximate to the outlet of said pump for guiding the pump assembly as same is lowered in said body of fluid, and said aligning elements co-operating together at least for a relatively short distance above the final resting position of said pump assembly, in order that as said pump assembly is further lowered, the outlet of said pump is aligned with said discharge pipe as said assembly and discharge pipe are brought into an abutting relationship at said resting position of said pump assembly.

3. The submersible electric motor-pump assembly according to claim 2, wherein said fixed reference is said discharge pipe.

4. The submersible electric motor-pump assembly according to claim 2, wherein said fixed reference is a base connection plate disposed between and connectable to said discharge pipe and said outlet of said pump.

5. The submersible electric motor-pump assembly according to claim 2, wherein said fixed reference is said circular pipe-like element.

6. The submersible electric motor-pump assembly according to claim 2, wherein one of said alignment elements is a guide sleeve provided with a rib on the inside surface of said guide sleeve; and the other of said alignment elements is in the form of an aligning slot or slit provided in a tubular member for aligning the outlet of said motor-pump assembly with said discharge pipe.

7. The submersible electric motor-pump assembly according to claim 2, wherein one of said alignment elements is a guide sleeve provided with a slit through the wall of said guide sleeve; and the other of said alignment elements is in the form of a rib engageable with said slot or slit for aligning the outlet of said motor-pump assembly with said discharge pipe.

8. The submersible electric motor-pump assembly according to claim 2, wherein one of said alignment elements is a guide sleeve provided with a slit therethrough and a pair of lower surfaces sloping downwardly from said slit toward each other for guiding said other alignment element into said slit.

9. The submersible electric motor-pump assembly according to claim 2, wherein one of said alignment elements is a guide sleeve provided with internally grooved passage means, including a vertical slot; said grooved passage means sloping toward said slot for guiding said other alignment element into said slot, thereby guiding said outlet of said pump in abutting relationship to said discharge pipe.

10. The submersible electric motor-pump assembly according to claim 2, wherein one of said alignment elements is an aligning rail secured to said fixed stationary reference; and the other alignment element is a slit guide sleeve, secured to said pump with said sleeve disposed about said circular pipe-like element, and said slit co-operating with said aligning rail for guiding said outlet of said pump in abutting relationship to said discharge pipe.

11. The submersible electric motor-pump assembly according to claim 2, wherein one of said alignment elements is an aligning rail secured to a base connection plate disposed between and connectable to said discharge pipe and said outlet of said pump; and the other alignment element is an internally grooved guide sleeve, secured to said pump with said sleeve disposed about said circular pipe-like element, and said groove co-operating with said aligning rail for guiding said outlet of said pump in abutting relationship to said discharge pipe.

12. The submersible electric motor-pump assembly according to claim 2, wherein one of said alignment elements is in the form of a stationary, flat-like aligning rail.

13. The submersible electric motor-pump assembly according to claim 12, wherein the other of said alignment elements is in the form of a sleeve having a slit.

14. The submersible electric motor-pump assembly according to claim 2, wherein one of said alignment elements is in the form of a fixed pin.

15. The submersible electric motor-pump assembly according to claim 14, wherein the other of said alignment elements is in the form of a sleeve having a slot-like key-way.

16. The submersible electric motor-pump assembly according to claim 2, wherein one of said alignment elements is in the form of a fixed, short rib.

17. The submersible electric motor-pump assembly according to claim 16, wherein the other of said alignment elements is in the form of a sleeve having a grooved passageway.

18. A submersible electric motor-pump assembly having a drive motor and a pump connected therewith, which is lowerable into a body of fluid with the outlet of said pump being guided into engagement with a discharge pipe, comprising: co-operatively associated male and female aligning elements, one of which is secured to a fixed stationary reference and the other being secured to said moveable motor-pump assembly; a single circular pipe-like element extending upwardly from a fixed position proximate to the outlet of said pump for guiding the pump assembly as same is lowered in said body of said fluid, said aligning element which is fixedly secured being a slit guide sleeve having a pair of upper surfaces sloping downwardly to said slit for guiding said other alignment element into said slit, and the other alignment element is a moveable guide sleeve having a rib-like element extending from the inside surface of said moveable guide sleeve, whereby said rib-like element, and said slit guide the outlet of said pump into abutting relationship to said discharge pipe as said aligning elements co-operate together at least for a relatively short distance above the final resting position of said pump assembly, in order that as said pump assembly is further lowered, the outlet of said pump is aligned with said discharge pipe as said assembly and discharge pipe are brought into an abutting relationship at said resting position of said pump assembly.

* * * * *